US008202019B2

(12) United States Patent
Lyddon et al.

(10) Patent No.: US 8,202,019 B2
(45) Date of Patent: Jun. 19, 2012

(54) VEHICLE ARRESTING DEVICE

(75) Inventors: Christopher James Lyddon, Farnborough (GB); Adrian Mark Woodhouse, Farnborough (GB); Julian Glen Moody, Farnborough (GB)

(73) Assignee: Qinetiq Limited (GB)

( * ) Notice: Subject to any disclaimer, the term of this patent is extended or adjusted under 35 U.S.C. 154(b) by 0 days.

(21) Appl. No.: 12/951,663

(22) Filed: Nov. 22, 2010

(65) Prior Publication Data

US 2011/0064516 A1 Mar. 17, 2011

Related U.S. Application Data

(63) Continuation of application No. 10/544,297, filed as application No. PCT/GB2004/000048 on Jan. 8, 2004, now Pat. No. 7,862,251.

(30) Foreign Application Priority Data

Feb. 12, 2003 (GB) ..... 0303119.2

(51) Int. Cl.
*E01F 13/00* (2006.01)
*E01F 9/00* (2006.01)

(52) U.S. Cl. ..... 404/6

(58) Field of Classification Search ..... 404/6; 256/13.1
See application file for complete search history.

(56) References Cited

U.S. PATENT DOCUMENTS

| | | | | |
|---|---|---|---|---|
| 4,456,205 | A | 6/1984 | Alavoine et al. | |
| 4,596,731 | A | 6/1986 | Cudmore et al. | |
| 4,759,655 | A | 7/1988 | Gorlov | |
| 5,310,277 | A | 5/1994 | Uotila | |
| 5,624,203 | A | 4/1997 | Jackson et al. | |
| 5,634,738 | A | 6/1997 | Jackson et al. | |
| 5,823,705 | A | 10/1998 | Jackson et al. | |
| 5,993,104 | A | 11/1999 | Marcotullio et al. | |
| 6,220,781 | B1 | 4/2001 | Miller | |
| 6,312,188 | B1 | 11/2001 | Ousterhout et al. | |
| 6,312,189 | B1 | 11/2001 | Marphetia | |
| 6,322,285 | B1 | 11/2001 | Ben | |
| 6,409,420 | B1 | 6/2002 | Horton et al. | |
| 2002/0085880 | A1 | 7/2002 | Schneider et al. | |
| 2006/0140715 | A1 | 6/2006 | Lyddon et al. | |
| 2009/0263190 | A1 * | 10/2009 | Segal | 404/6 |
| 2009/0317185 | A1 * | 12/2009 | Coomber et al. | 404/6 |
| 2010/0178104 | A1 * | 7/2010 | Bare et al. | 404/6 |
| 2010/0284739 | A1 * | 11/2010 | Allsopp et al. | 404/6 |

FOREIGN PATENT DOCUMENTS

| | | |
|---|---|---|
| CA | 2 393 380 | 12/2002 |
| EP | 0 280 076 | 8/1988 |

* cited by examiner

*Primary Examiner* — Raymond W Addie
(74) *Attorney, Agent, or Firm* — McDonnell Boehnen Hulbert & Berghoff LLP

(57) ABSTRACT

A vehicle arresting device comprises a net intended to be laid flat on the ground in the path of an oncoming vehicle to be arrested. Two rows of barbed spikes are attached to the net along its leading edge. When a vehicle runs over the device the spikes lodge in its front tires and the net is caused to wrap around the front wheels, eventually being pulled tight under the vehicle so that the tension in the net prevents further rotation of the wheels and the vehicle is brought to a stop. The net is manufactured such that in its deployed condition it has sufficient lateral stretch to allow it to become fully wrapped around the front wheels before the tension builds up to a level at which there might otherwise be a risk of the spikes being pulled from the tires.

13 Claims, 7 Drawing Sheets

VEHICLE ARRESTING DEVICE

CROSS REFERENCE TO RELATED APPLICATIONS

This application is a continuation of U.S. application Ser. No. 10/544,297, filed on Aug. 3, 2005, now U.S. Pat. No. 7,862,251, which is a 371 application of International application serial no. PCT/GB04/00048, filed on Jan. 8, 2004, which claims priority from Great Britain patent application serial no. 0303119.2 filed Feb. 12, 2003, the specifications of each of which are incorporated herein by reference in their entirety.

BACKGROUND OF THIS INVENTION

The present invention relates to vehicle arresting devices, such as may be deployed by law enforcement agencies to safely stop the progress of a suspect vehicle for example if stolen or engaged in other criminal activity.

Vehicle pursuit is one of the most common high-risk areas of law enforcement and many people are killed each year as a result of high speed chases. An alternative method for stopping, or attempting to stop, a fleeing vehicle which is quite widely practiced is to deploy on the roadway ahead of the vehicle a device intended to puncture its tires. A common form of this type of device comprises a lightweight plastics latticework which is laid across the road and carries a number of tubular spikes. When the target vehicle passes over the device some of the spikes penetrate its tires and are carried along with the vehicle enabling deflation of the respective tire(s) through their hollow construction. While tire deflation significantly retards a vehicle and makes it difficult to control, devices of this kind do not necessarily result in the vehicle being stopped, or may do so only after the suspect has been able to continue driving "on the rims" for a considerable distance further.

Another form of device intended for more positive arresting of the progress of a vehicle is proposed in U.S. Pat. No. 6,220,781. This device comprises a panel of lightweight material, such as silk, to be laid on the roadway and having a tactile surface at its leading edge formed from barbed pins and/or adhesive blisters. A split seam extends through the panel from the centre of its leading edge to approximately three-quarters of its length (in the fore and aft direction) and a reinforcement sash of Kevlar® or similar material is affixed to the panel and extends in a partial loop around the split. The intention is that when a vehicle encounters this device its leading edge will adhere to the front wheels so that the panel will wrap around the wheels until, when the limit of the split seam is reached, the reinforcement sash is drawn tight under the vehicle thereby preventing further rotation of the wheels. It is essential to this operation, however, that the vehicle encounters the device with its front wheels disposed either side of the split seam, and important that they run directly over the relatively narrow reinforcement sash in order to ensure that the latter becomes wrapped around the wheels. In other words the operation is sensitive to the correct lateral positioning of the vehicle relative to the device, and it is likely to be successful only where the vehicle can be constrained to pass through a relatively narrow gap where the device is deployed.

SUMMARY OF THE INVENTION

The present invention seeks to overcome the above-mentioned drawbacks of the prior art and in a first aspect resides in a vehicle arresting device comprising a net adapted to be laid flat on the ground in the path of a vehicle to be arrested with one or more transverse rows of upwardly-directed spikes attached to the net at a leading portion thereof, the loops of said net being oriented with a longer dimension in the fore and aft direction than in the transverse direction, whereby in use any widthwise portion of the net is capable of substantial transverse elongation.

In a second aspect the invention resides in a method of arresting a vehicle which comprises laying a device according to the first aspect of the invention on the ground in the path of the vehicle such that when the front tires of the vehicle run over the leading portion of the device one or more said spikes become embedded in each said tire, the net becomes wrapped around the front wheels of the vehicle, and the portion thereof between the wheels of the vehicle is pulled tight under the vehicle, thereby preventing further rotation of those wheels.

By virtue of the transverse stretchability of the net in a device according to the invention it can readily absorb the loads which are imposed on it as it pulls tight under a vehicle in use of the device, and readily ensure that it is fully wrapped around the vehicle's wheels before pulling tight. Furthermore the device can be effective to arrest a vehicle irrespective of the particular position across its width over which the front tires of the vehicle run and is not limited in this respect to the critical relative positioning of a split seam and reinforcement sash as in the case of the device of U.S. Pat. No. 6,220,781.

In another aspect the invention resides in a method of constructing a vehicle arresting device according to the first aspect of the invention which comprises: taking a net and deforming the same to elongate the loops thereof in the intended fore and aft direction of the device while reducing the dimension of the net in the intended transverse direction; and attaching elongate elements of flexible material between opposite side edges of the net, whereby to retain the net in such deformed condition when laid on the ground in preparation for arresting a vehicle.

In a further aspect the invention resides in a spike assembly for use in a vehicle arresting device comprising a base portion whereby the spike can be stood in an upwardly-directed orientation, a shaft portion extending from said base portion and a generally pyramidal barb portion at the tip of said shaft portion.

DESCRIPTION OF THE FIGURES

These and other features of a vehicle arresting device according to the invention will now be more particularly described, by way of example, with reference to the accompanying drawings of a preferred embodiment thereof and in which.

DETAILED DESCRIPTION OF THE INVENTION

Figure 1:
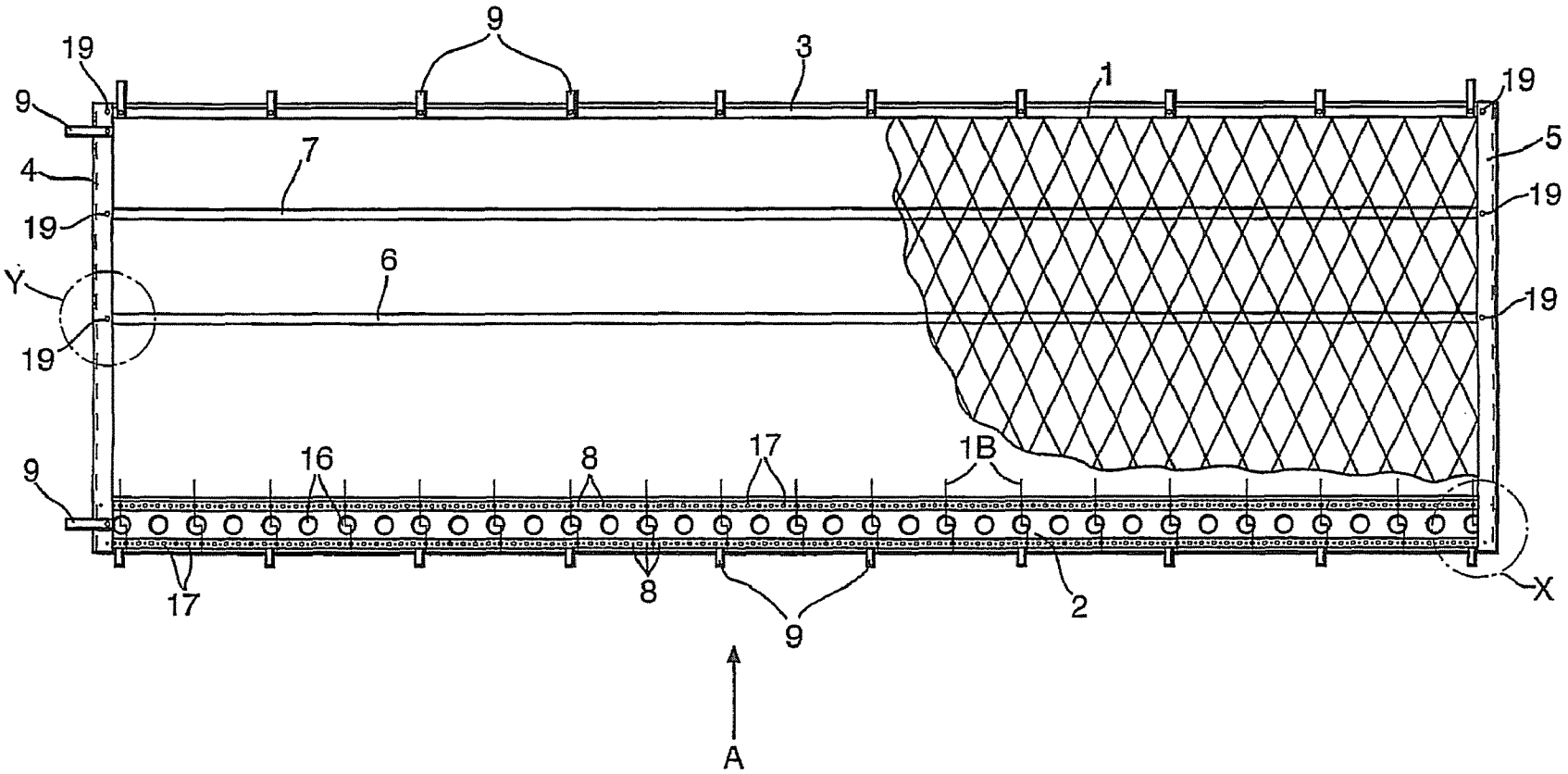
FIG. 1 is a plan view of a preferred form of vehicle arresting device in its deployed configuration.

With reference to FIG. 1 there is shown a plan view of a vehicle arresting device in accordance with the invention in its deployed configuration, that is to say laid flat upon the ground with the intention of arresting a vehicle traveling in the direction of arrow A. The device comprises a net 1 of rectangular planform (the mesh of which is illustrated only schematically in FIG. 1 but is more accurately depicted in FIGS. 7 and 9). The net 1 is preferably woven from high breaking strain braided polyethylene and is similar in this respect to commercial fishing netting. In the illustrated condition the overall shape of the net is maintained by strips of flexible material 2, 3, 4, 5, 6 and 7 attached respectively at its leading and trailing edges (in the sense of its orientation to oncoming traffic), side edges and transversely at two intermediate locations. At the leading edge there are two transverse rows of upwardly-directed hardened steel spikes 8, the form of which will be more particularly described with reference to FIGS. 2 to 6. Tapes 9 are also attached to the strips 2, 3 and 4 at the leading, trailing and one side edge in order to facilitate the manual folding and deployment of the assembled device.

Figure 2:
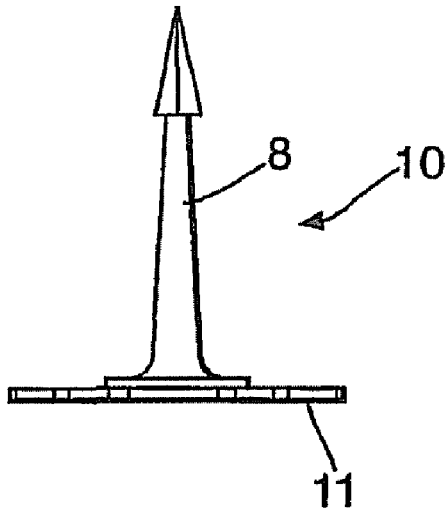
FIGS. 2 and 3 are respectively a side elevation and an underneath plan view of a typical spike assembly incorporated in the device of FIG. 1, to an enlarged scale.
Figure 3:
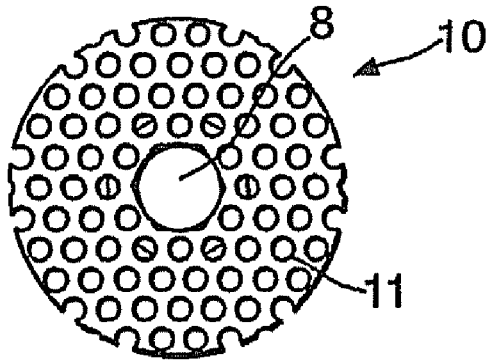
Figure 4:
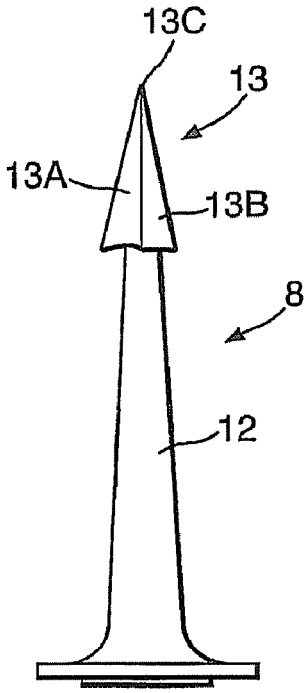
FIGS. 4 and 5 are respectively a side elevation and a top plan view of the spike in 15 the assembly of FIGS. 2 and 3, to a further enlarged scale.
Figure 5:
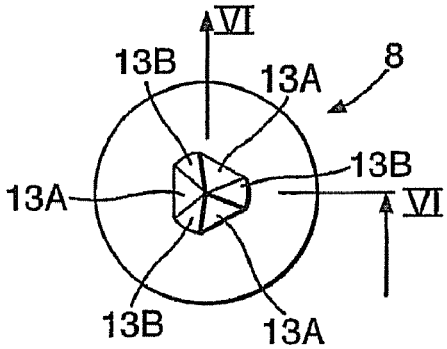
Figure 6:
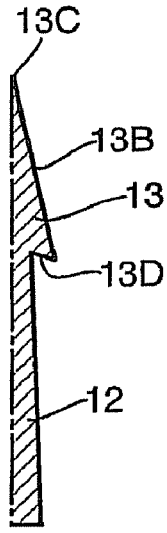
FIG. 6 is a partial section on the fine VI-VI of FIG. 5.

With reference to FIGS. 2 and 3 each spike 8 is part of an assembly 10 comprising also a perforated steel base 11 welded to the respective spike. The relatively wide base 11 helps to ensure that the spike remains upright when the device is laid on the ground, and is perforated to minimize the weight of the assembly. As shown in FIGS. 4 to 6, each spike 8 is machined to define a shaft 12 tipped with a sharply pointed, generally pyramidal barb 13. More particularly the barb 13 is polygonal in planform, being machined from a solid cone to provide three major flat faces 13A between three minor frustoconical faces 13B with a common vertex 13C, and is undercut at its base as indicated at 13D in FIG. 6. This form of barb with flats 13A machined into a cone has been found to require less force to penetrate conventional tyro tire rubber than the equivalent plain cone.

Figure 7:
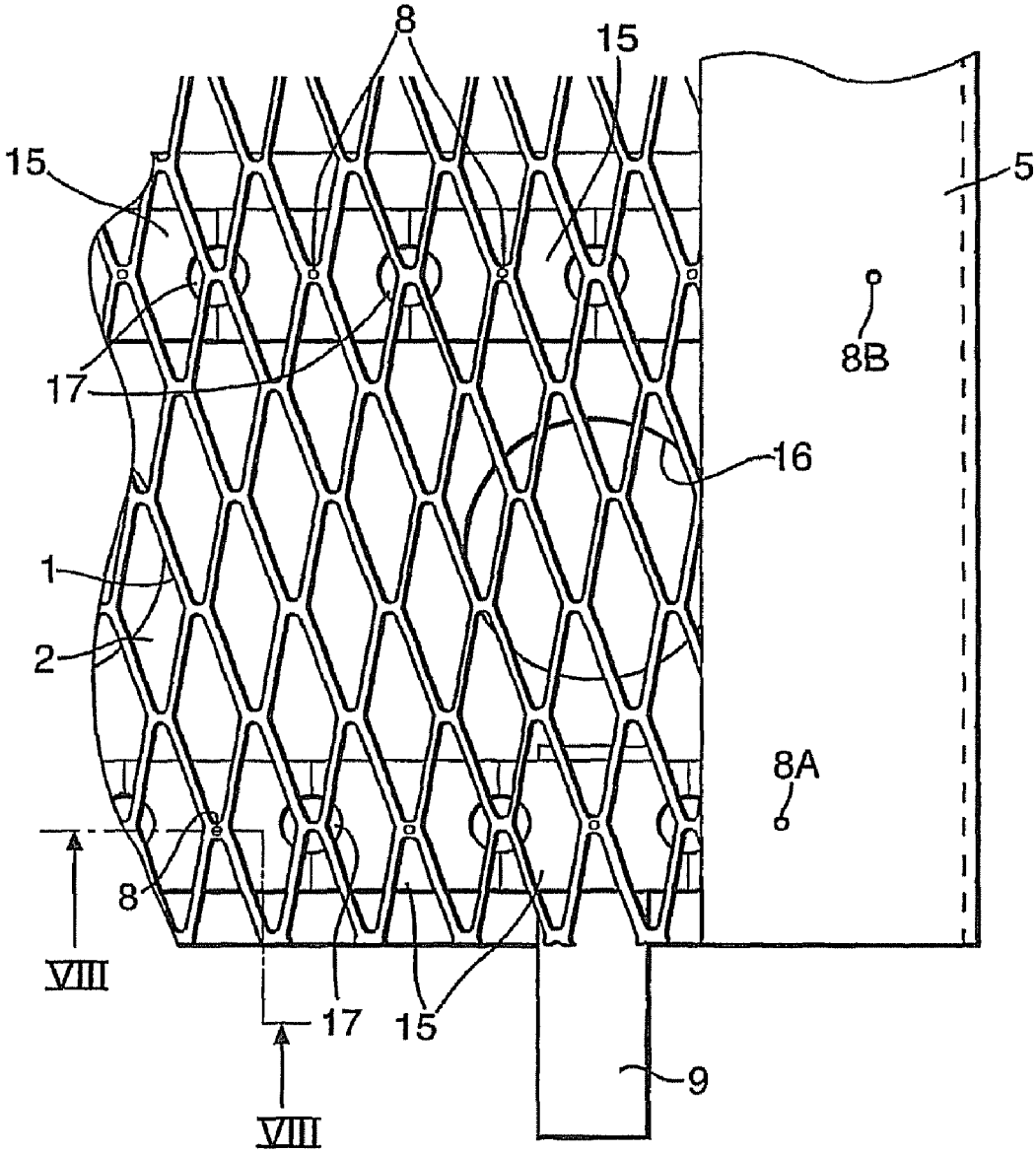
FIG. 7 is a view to an enlarged scale of the region of the device indicated at 'X' in FIG. 1.
Figure 8:
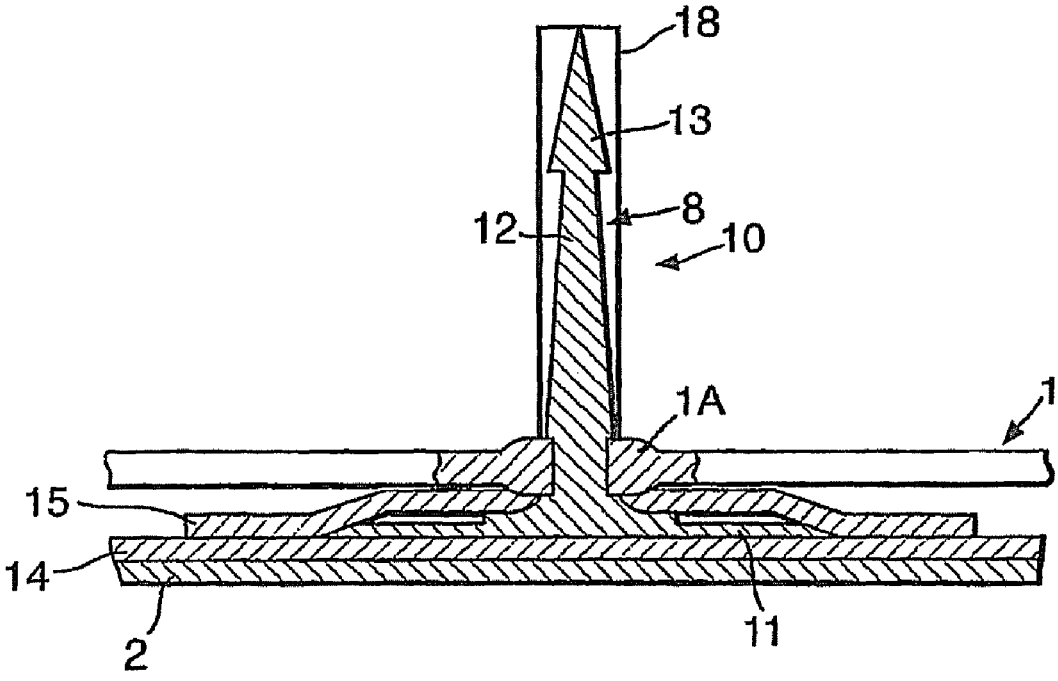
FIG. 8 is a section on the line VIII-VIII of FIG. 7, to a further enlarged scale.

FIGS. 7 and 8 show the relationship of the net 1, spike assemblies 10 and leading edge strip 2. In each row there is a spike 8 located at each alternate knot across the width of the net 1, with the two rows laterally offset from each other by one knot. The spikes are held on the strip 2 at the correct spacing by multiple hook and loop contact fastener material such as that known under the registered trade mark Velcro. Lengths of Velcro® hook material 14 (FIG. 8) are sewn to the leading edge strip 2 where the two rows of spikes are required and the spike assemblies 10 are attached by respective pads of Velcro® loop material 15 passing over the spike assembly bases 11 and into contact with the hook material 14, the pads 15 being apertured to pass the spikes 8. Holes 16 and 17 are shown cut through the material of the strip 2 and (in the case of holes 17) through the associated Velcro® fasteners in FIGS. 1 and 7 to reduce both the weight of the overall assembly and any aerodynamic forces due to wind acting on the leading edge of the device when deployed.

Having attached the spike assemblies 10 to the leading edge strip 2 they are assembled with the net 1 by thrusting the barb 13 of each spike through the respective knot of the net and passing the knot down to engage frictionally around its shaft 12, as shown for the knot IA in FIG. 8. A plastics tube 18 is passed over the exposed length of each spike 8 to resist lifting of the net along the shaft 12 and to prevent the barb 13 snagging on the net when it is folded for storage and transportation.

Figure 9:
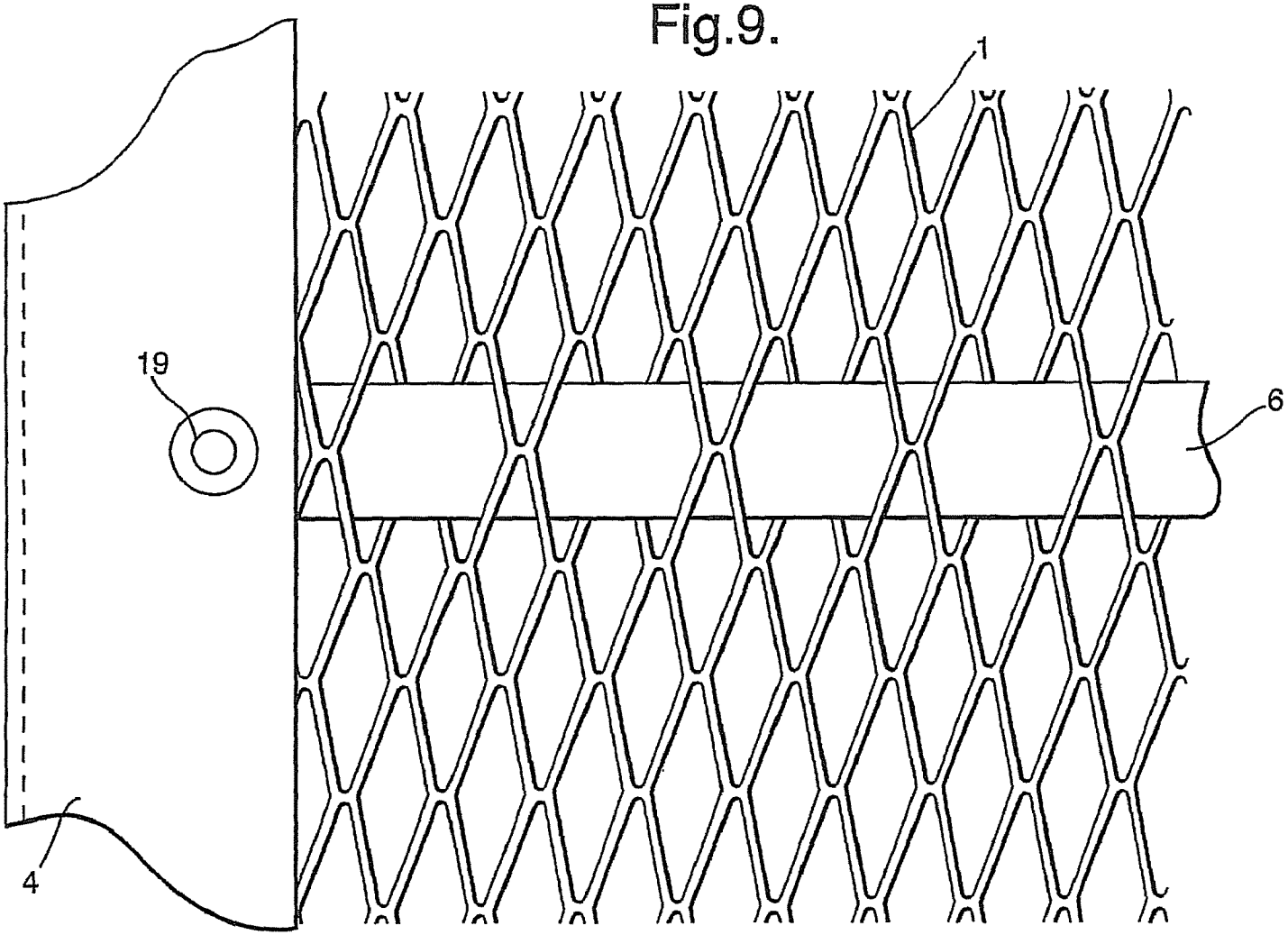
FIG. 9 is a view to an enlarged scale of the region of the device indicated at 'Y' in FIG. 1, from beneath.

FIG. 9 shows the relationship of the intermediate strip 6, net 1 and side strip 4, the equivalent applying to the opposite side strip 5 and for the trailing edge strip 3 and other intermediate strip 7. The strip 6 comprises a length of webbing which is threaded through loops of the net 1 across its width as illustrated. At each side edge the respective strip 4 or 5 is folded over the net 1 and over the ends of the strips 2 (see also FIGS. 7), 3, 6 and 7, and glued thereto. To further anchor the side strips 4 and 5 to the ends of the strips 3, 6 and 7 rivets 19 are applied, passing through the material of the respective strips and a local loop of the net. At the leading edge, the side strips 4 and 5 are apertured to pass the outermost spikes 8A, 8B in each row, as shown for the strip 5 in FIG. 7.

The illustrated device is designed to be man-portable and is normally kept folded in an appropriate backpack, from which it can rapidly be unfolded and deployed across a roadway when a target vehicle is to be arrested.

In use, when a vehicle encounters the deployed device from the direction of arrow A in FIG. 1, its front tires will run over a number of adjacent spikes 8 in each of the rows. As a respective spike is encountered the surrounding tube 18 (FIG. 8) is crushed down by the tire, allowing the spike to penetrate the tire. The barb 13 is shaped to facilitate entry of the spike into the tire, and its undercut 13D (FIG. 6) is designed to catch on the conventional steel braiding within a tire carcass to resist removal. The net 1 therefore becomes attached to the wheels of the vehicle at two locations across its width, being trapped between the bases of the respective spike assemblies and the tires in which the spikes are embedded. Continued movement of the vehicle therefore causes the net to wrap around the front wheels and the portion between the wheels is pulled tight under the vehicle until its tension prevents further rotation of the wheels, thereby bringing the vehicle to a stop. In practice this occurs in a similar distance to an emergency stop as if the vehicle's brakes had been applied.

Figure 10A:
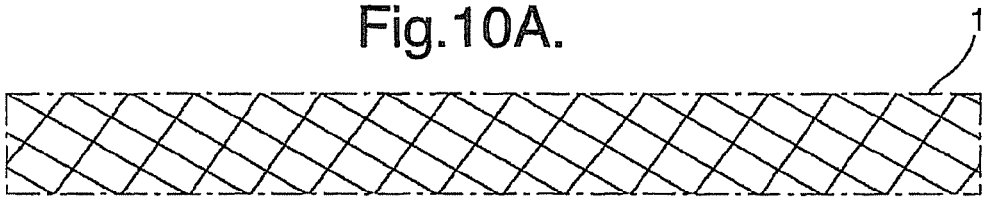
FIGS. 10(*a*) and 10(*b*) illustrate schematically the configuration of the net incorporated in the device of FIG. 1 in its natural woven condition and in the condition in which it is assembled respectively.
Figure 10B:
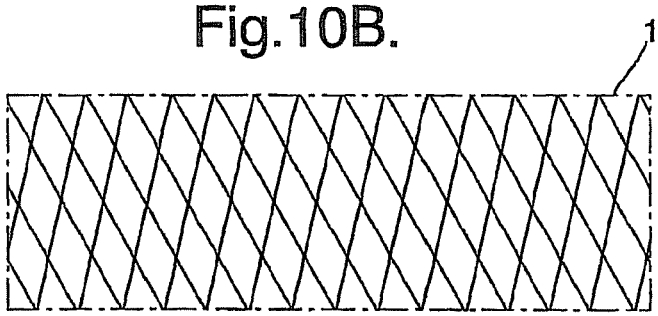

It is important to the successful operation of the device that the net 1 has sufficient lateral stretch to absorb the loads that are imposed on it as it pulls tight to arrest a vehicle, and to allow the net to become fully wrapped around the front wheels before the tension builds up to a level at which there might otherwise be a risk of the spikes 8 being pulled from the tires. In this respect it will be noted from FIGS. 7 and 9 that in the initial deployed condition of the device the loops of the net are in a diamond shape with the longer dimension in the fore and aft direction. It is therefore capable of significant lateral elongation before the loops are pulled to a condition in which their longer dimension is in the transverse direction and the net begins to tighten. More particularly, the "natural" form of the loops in which the net is originally woven is rectangular with the longer dimension in the transverse direction, as schematically depicted in FIG. 10(*a*) (where the size of the loops is greatly exaggerated in relation to the overall size of the net for ease of illustration). In the course of assembly of the device, before the strips 2 to 7 are attached, the net is pulled out of the "natural" shape of FIG. 10(*a*) and held in a jig in the less elongate aspect ratio schematically depicted in FIG. 10(*b*) in which it is subsequently retained by the attachment of the strips 2 to 7. Note, however, that the presence of these strips does not prevent the portion of the net between the wheels of a vehicle elongating laterally in use of the device because it is not constrained in that sense by positive attachment to the strips 6, 7 and 3 intermediate its attachment to the side strips 4 and 5, and at the leading edge its attachment to strip 2 is by means of the Velcro® pads 15 over the bases of the spikes 8 which can pull off from the Velcro® material 14 as the net stretches.

It will also be noted that the device can operate to arrest a vehicle as described above so long as both front tires run over its leading edge, irrespective of the position across the width of the device where this actually occurs.

In order to enhance the initial attachment of the net 1 to the vehicle's tires its leading edge may be formed with a series of short longitudinal cuts spaced across its width, as schematically indicated at 1B in FIG. 1. By this means only the respective section of the net between the adjacent cuts has to be lifted by the tire during the initial part of its rotation after contacting the spikes 8, which further minimize the risk of the spikes being pulled from the tire.

What is claimed is:

1. A vehicle arresting device comprising a flexible substrate comprising a net that, in use, is located on the ground in the path of a vehicle to be arrested and has one or more transverse rows of upwardly-directed spikes attached to the flexible substrate at a leading portion thereof such that when the front tires of a vehicle run over said leading portion one or more said spikes become embedded in each said tire, the flexible substrate becomes wrapped around the front wheels of the vehicle, and a portion of the flexible substrate between those wheels of the vehicle is pulled tight under the vehicle, thereby preventing further rotation of those wheels, wherein respective said spikes are attached to the flexible substrate with respective portions of the flexible substrate surrounding respective shaft portions of those spikes.

2. A device according to claim 1 wherein respective said spikes are comprised in respective spike assemblies comprising a base portion and a barb portion at opposite ends of the respective said shaft portion.

3. A device according to claim 2 wherein respective portions of the flexible substrate surround respective said shaft portions at a position adjacent to the respective said base portion.

4. A device according to claim 1 wherein the flexible substrate, in use, lies flat on the ground in the path of the vehicle to be arrested.

5. A device according to claim 1 wherein respective said spikes are attached to the flexible substrate with respective portions of the net surrounding respective shaft portions of those spikes.

6. A device according to claim 5 wherein respective said spikes are attached to the net at respective junctions between adjacent loops of the net.

7. A device according to claim 1 wherein the loops of the net are of diamond shape.

8. A device according to claim 1 comprising a plurality of elongate elements of flexible material extending transversely of the net at spaced locations and attached to the net at its opposite side edges.

9. A device according to claim 8 wherein one or more of said elongate elements is threaded through loops of the net between said side edges and securely attached to the net at said side edges.

10. A device according to claim 8 wherein one or more of said elongate elements is held to the net between said side edges by virtue of separable hook and loop material and securely attached to the net at said side edges.

11. A device according to claim 8 wherein respective said spikes are comprised in respective spike assemblies comprising a base portion at one end of the respective said shaft portion and said spike assemblies are attached to a said elongate element at a leading portion of the net by means of separable hook and loop material, elements of which material are interengaged with said base portions of respective said spike assemblies located therebetween.

12. A device according to claim 1 wherein the flexible substrate is formed into a plurality of separate widthwise sections at said leading edge thereof.

13. A method of arresting a vehicle which comprises locating a device according to claim 1 on the ground in the path of the vehicle such that when the front tires of the vehicle run over the leading portion of the device one or more said spikes become embedded in each said tire, the flexible substrate becomes wrapped around the front wheels of the vehicle, and a portion of the flexible substrate between those wheels of the vehicle is pulled tight under the vehicle, thereby preventing further rotation of those wheels.

* * * * *